US009821240B2

(12) United States Patent
Hansen et al.

(10) Patent No.: US 9,821,240 B2
(45) Date of Patent: Nov. 21, 2017

(54) TOY BAR

(71) Applicant: KIDS II, INC., Atlanta, GA (US)

(72) Inventors: Nicholas Brian Hansen, Fayetteville, GA (US); Bradford Reese, Decatur, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 14/847,755

(22) Filed: Sep. 8, 2015

(65) Prior Publication Data

US 2016/0067623 A1 Mar. 10, 2016

Related U.S. Application Data

(60) Provisional application No. 62/047,732, filed on Sep. 9, 2014.

(51) Int. Cl.

| | |
|---|---|
| ***A63H 33/00*** | (2006.01) |
| ***A63H 33/40*** | (2006.01) |
| ***A63H 33/22*** | (2006.01) |
| ***A63H 5/00*** | (2006.01) |

(52) U.S. Cl.

CPC ..... *A63H 33/006* (2013.01); *A63H 5/00* (2013.01); *A63H 33/22* (2013.01); *A63H 33/40* (2013.01)

(58) Field of Classification Search

USPC ..... 446/219, 227, 242, 484

See application file for complete search history.

(56) References Cited

U.S. PATENT DOCUMENTS

| | | | | |
|---|---|---|---|---|
| 4,915,666 | A * | 4/1990 | Maleyko | A63B 19/00 446/242 |
| 5,653,529 | A * | 8/1997 | Spocharski | F21L 4/027 362/184 |
| 6,113,455 | A | 9/2000 | Whelan et al. | |
| 6,149,489 | A * | 11/2000 | Johnson | A63H 33/006 297/183.1 |
| 6,357,462 | B1 | 3/2002 | Laosunthara et al. | |
| 6,592,425 | B2 | 7/2003 | Bapst et al. | |
| 6,645,038 | B2 | 11/2003 | Trotto | |
| 6,702,643 | B1 * | 3/2004 | Drosendahl | A63H 33/006 446/175 |
| 6,746,299 | B1 * | 6/2004 | Graf | A63H 33/006 446/227 |
| 6,810,545 | B1 | 11/2004 | Darling et al. | |
| 6,994,605 | B2 * | 2/2006 | Baxter | A63H 33/22 362/249.08 |

(Continued)

*Primary Examiner* — Kurt Fernstrom

(74) *Attorney, Agent, or Firm* — Gardner Groff Greenwald & Villanueva, PC

(57) ABSTRACT

A toy bar for placement over or in front of a child to provide entertainment. The toy bar includes a tube component and first and second support members. The tube component generally includes a first end and a second end, and the first and second support members are generally removably attached to the tube component. Optionally, an LED light component fitted within the tube component. Optionally, at least one of the support members includes an electronic module, and wherein the electronic module can be programmed to activate one or more of a plurality of entertainment or soothing features including playing sounds, the LED light component, or a vibration unit. Optionally, one or more toys, loops or fasteners are coupled to the tube component.

21 Claims, 4 Drawing Sheets

(56) References Cited

U.S. PATENT DOCUMENTS 7,062,146 B2 6/2006 Elias et al.
7,302,724 B2 12/2007 Solomon et al.
7,361,074 B1 * 4/2008 Periman ..... A63H 5/00 362/192
7,490,379 B2 2/2009 Solomon et al.
7,766,721 B2 * 8/2010 Ma ..... A63H 33/009 446/473
8,070,552 B2 12/2011 Snyder
8,328,594 B2 * 12/2012 Hall ..... A47D 13/06 446/220
8,460,053 B2 6/2013 Fair et al.
8,511,856 B2 * 8/2013 Brauser ..... A01K 27/006 119/859
8,795,023 B2 8/2014 Elson
8,864,546 B1 * 10/2014 Capriola ..... A63H 33/042 331/3
8,864,547 B2 10/2014 Elson et al.
8,882,557 B2 * 11/2014 Fair ..... A63H 33/006 446/227
8,920,208 B2 12/2014 Elson
8,992,283 B2 3/2015 Piwko, Jr. et al.
9,011,196 B2 * 4/2015 Weisman ..... A63H 33/006 446/227
9,155,974 B2 10/2015 Fair et al.
D744,046 S * 11/2015 Chen ..... D21/398
2001/0003695 A1 * 6/2001 Tell ..... A63H 33/006 446/227
2002/0118535 A1 8/2002 Nostrant
2003/0201662 A1 10/2003 Armbruster et al.
2005/0026536 A1 2/2005 Armbruster et al.
2005/0172411 A1 8/2005 Snedeker
2006/0052172 A1 3/2006 Stephen et al.
2006/0199166 A1 9/2006 Snyder et al.
2006/0199467 A1 9/2006 Snyder
2009/0017718 A1 1/2009 Bryan et al.
2009/0253342 A1 * 10/2009 Oren ..... A47D 5/006 446/227
2010/0221974 A1 * 9/2010 Monaghan ..... A47D 11/00 446/75
2011/0154572 A1 6/2011 Fair et al.
2013/0065478 A1 * 3/2013 Gunter ..... A63H 33/22 446/219
2014/0308873 A1 * 10/2014 Spacek ..... A63H 33/006 446/175

* cited by examiner

TOY BAR

CROSS-REFERENCE TO RELATED APPLICATION

This application claims the benefit of U.S. Provisional Patent Application Ser. No. 62/047,732 filed Sep. 9, 2014, the entirety of which is hereby incorporated herein by reference for all purposes.

TECHNICAL FIELD

The present invention relates generally to the field of children's toys, and more particularly to a toy bar for use with children's products.

BACKGROUND

Toy bars are commonly known and used for placement over a child to provide entertainment. Continued improvement to toy bars is sought. It is to the provision of improved toy bars that the present invention is primarily directed.

SUMMARY

In example embodiments, the present invention provides a toy bar for placement over or in front of a child to provide entertainment. In one aspect, the present invention relates to a toy bar including a lighted tube component and first and second foot members. The lighted tube component generally includes a first end and a second end, and is configured for emitting light therefrom. The first and second foot members are generally removably attached to the lighted tube component. In one form, the first foot member is removably attached to the first end and the second foot member is removably attached to the second end.

Optionally, an LED light component is fitted within the tube component. Generally, the first and second foot members are configured for resting upon a support surface. According to one form, at least one coupling removably couples the first and second foot members together. Optionally, the foot members are configured for removably coupling with a mat that is adapted for placing a child thereon. In one form, at least one strap extends from each side of the mat for removably coupling to their respective foot member. According to example forms, at least one of the foot members includes an electronic module, and wherein the electronic module can be programmed to activate one or more of a plurality of entertainment or soothing features including playing sounds, the LED light component, and/or a vibration unit. In example forms, one or more batteries are provided for powering the electronic module. Optionally, an adaptor can be provided for providing a temporary interface or intermediary connection between the LED light component and the electronic module. According to some example forms, a canopy is coupled to the tube component. Optionally, one or more toys, loops or fasteners are coupled to the tube component.

In another aspect, the invention relates to a toy bar including a light bar, a pair of support members, and a mat. The light bar includes a first end and a second end, and the pair of support members are generally coupled to the first and second ends of the light bar. The mat generally includes at least one coupling member for removably coupling the mat to at least one of the support members. In example forms, the light bar includes a tube component, a plurality of spacers, and an LED component. The LED component generally includes a plurality of color-changing RGB LEDs coupled in sequence along a length of a wire, and wherein the plurality of spacers are fitted within the tube component for positioning the LED component within the tube component.

Optionally, an electronic module is housed within at least one of the support members. In example forms, the electronic module can be programmed to activate one or more of a plurality of entertainment or soothing features including playing sounds, the LED light component, or a vibration unit. According to one form, one or more batteries are provided for powering the electronic module. Optionally, an adaptor is provided for providing an intermediary between the LED light component and the electronic module. In example forms, a canopy is coupled to the tube component. Optionally, one or more loops or fasteners are coupled to the light bar for coupling toys thereto.

In yet another aspect, the invention relates to a toy bar including a light tube having first and second ends and a conduit extending therethrough, and at least one light source positioned within the conduit. The at least one light source includes an LED strip that is positioned within the conduit by a plurality of positioning clips. According to one aspect, the toy bar further includes first and second feet. Each of the first and second feet include a lower support base and an upper coupling component. Coupling connectors are optionally included at the first and second ends of the light tube for engagement with the upper coupling elements of the first and second feet.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments of the invention are exemplary and explanatory, and are not restrictive of the invention as claimed.

DETAILED DESCRIPTION OF EXAMPLE EMBODIMENTS

Figure 1:
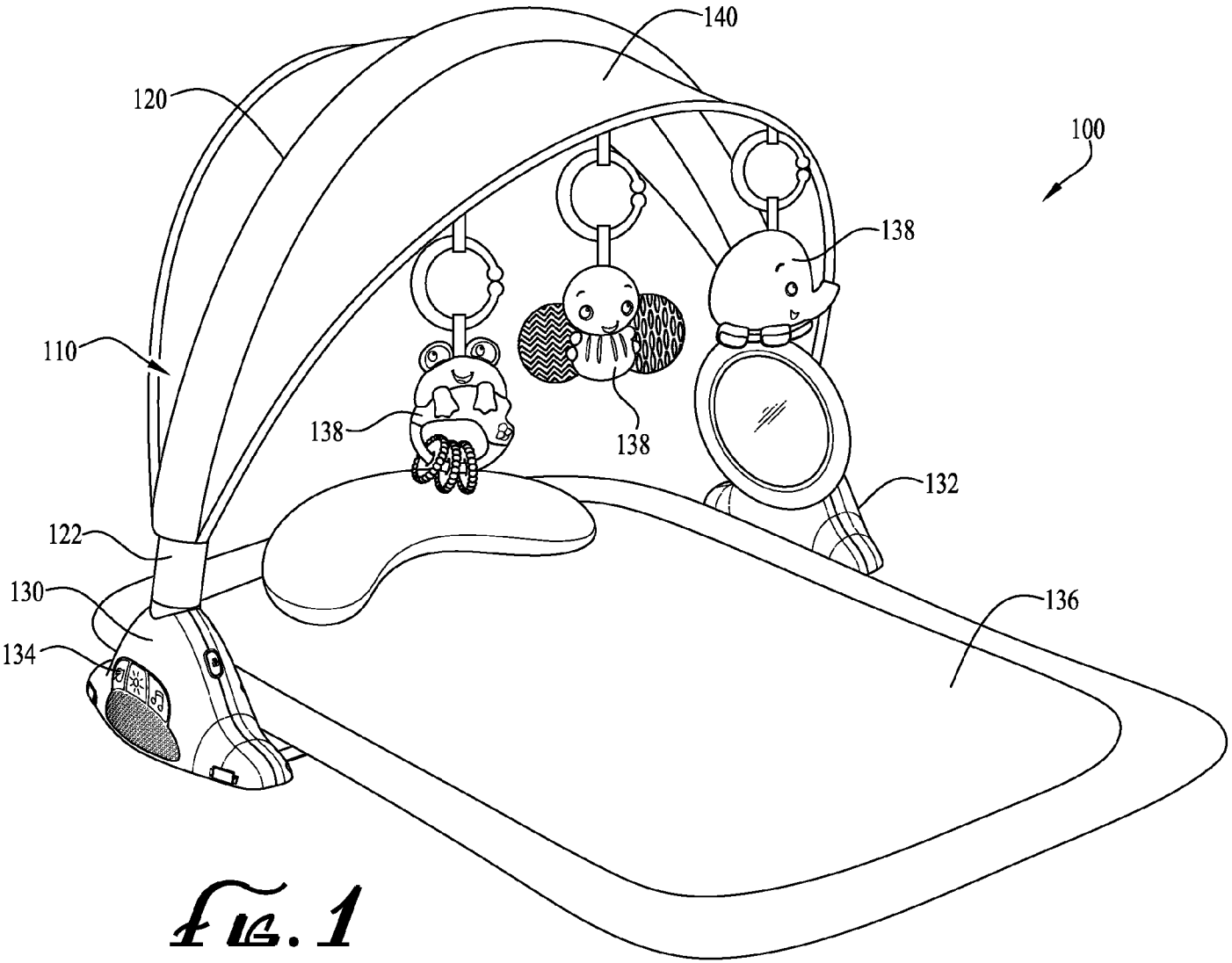
FIG. 1 is a perspective view of a toy bar according to an example embodiment of the present invention, and showing the toy bar removably attached to a mat for laying a child thereon.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-5 show a toy bar 100 according to example embodiments of the present invention. According to various example forms of the present invention, the toy bar 100 generally comprises a light bar 110, at least two feet or support members 130, 132, and an electronic module (see FIGS. 4-5). According to one example form, the toy bar 10 is generally configured for removably coupling to a mat 136 that is adapted to rest a child upon, which is generally supported by a support surface such as a floor or other generally flat surface. Optionally, the toy bar 10 can be used independently of the mat 136, for example, wherein support members or feet 130, 132 of the toy bar 10 rest against the support surface and maintain the light bar 110 in an upright position. In alternate embodiments, the support members 130, 132 can be replaced by one or more clamps, clips or other mechanisms for coupling the toy bar 100 to a children's support device, for example, a bassinet frame, a play yard frame, an entertainer, a high chair, a bouncer, a car seat, a stroller, or a swing or the like.

Figure 2:
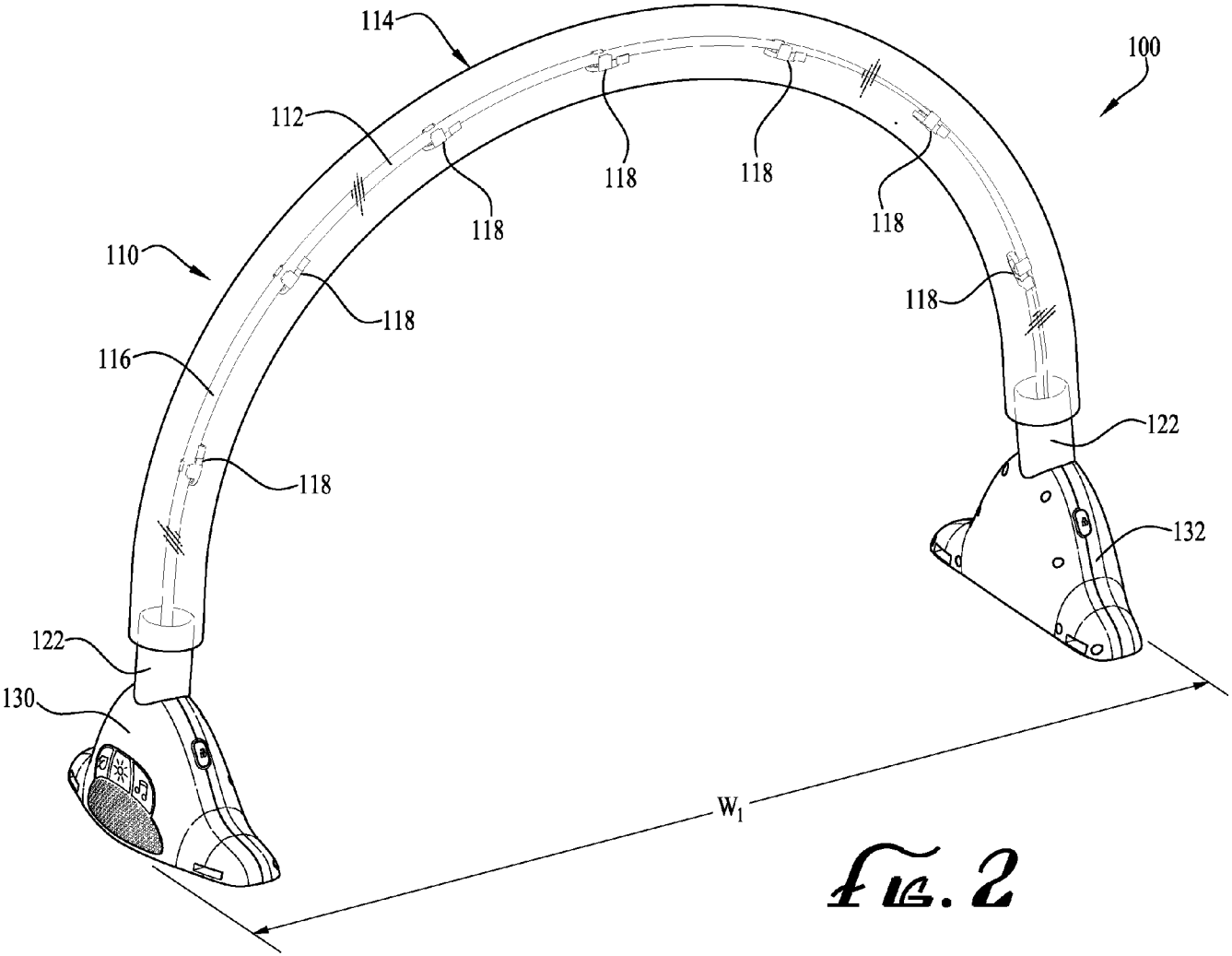
FIG. 2 is a perspective view of the toy bar of FIG. 1, with portions removed to show hidden components thereof.
Figure 3:
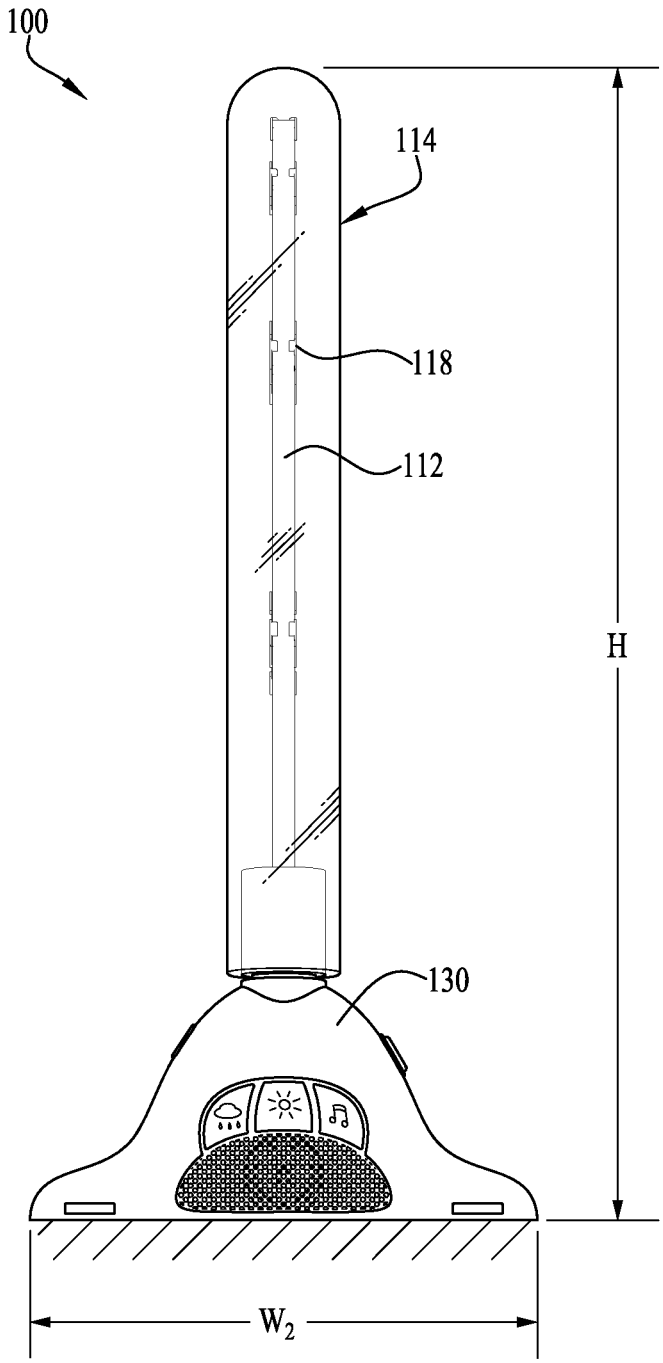
FIG. 3 is a side view of the toy bar of FIG. 2.

As depicted in FIG. 2, the light bar 110 generally comprises one or more light sources, such as for example a light emitting diode (LED) component 112 and a tube component 114. The tube component 114 generally comprises a first end, a second end generally opposite the first end, and a channel or conduit generally extending entirely therethrough, for example, which provides for the LED component 112 to be positioned within the tube component 114. According to example forms, the LED component 112 generally comprises a plurality of color-changing red-green-blue (RGB) LEDs coupled in sequence along the length of a wire 116, for example in the form of an LED light strip or light string. Alternatively, the LED component 112 can include one or more individual LEDs of one or more colors. According to one form, the LED component 112 is generally threaded through the tube component 114, and a plurality of spacers 118 are positioned within the channel of the tube component 114 (generally spaced along the length of the tube component 114), which are adapted to support, position and separate the LEDs within the tube component 114. In the depicted embodiment, the spacers 118 are substantially elliptical and have an outer dimension or major axis diameter approximately equal to the inside dimension or interior diameter (e.g., opening) of the tube component 114, thus positioning the LED component 112 at about the center of the opening of the tube component 114. Alternatively, the spacers 118 can have a different shape, for example, a generally radial shape, or other shapes which can be configured for placement within the opening of the tube component 114.

The tube component 114 can be formed from, for example, a foam tube. In other embodiments, the tube component 114 can be formed from a polymer or other suitably flexible or semi-flexible and resilient material, which may be at least partially transparent or translucent (e.g., to permit light from the LEDs to pass therethrough). In example embodiments, when disassembled, the tube component 114 may return to a generally elongate linear form having little to no curvature. Alternatively, the tube component 114 can comprise shape memory such that the tube component 114 remains curved or generally arcuate in shape, for example, regardless of whether or not it is removably coupled to the support members 130, 132 (or coupled indirectly to the mat 136 via the support members 130, 132). For example, according to one form, the tube component does impart an arcuate shape such that when coupled to the support members 130, 132, the width $W_1$ is between about 600-900 millimeters, more preferably about 790 millimeters. Optionally, the tube component 114 can further include a light-diffusing layer to create an interesting visual effect. As shown in FIG. 1, the tube component 114 can be at least partially disposed within a cover, such as a decorative fabric sleeve 120.

According to example forms, at least one end of the LED component 112 and the first or second end of the tube component 114 are coupled together by a coupling component 122, which connects the ends of the tube 114 with base support members or feet 130, 132. For example, as depicted in FIG. 2, each end of the light bar 110 terminates in coupling components 122, for example, wherein a first end of the LED component 112 is coupled to the first end of the tube component 114, and wherein the second end of the LED component 112 is generally coupled to the second end of the tube component 114. According to example forms, each coupling component 122 is adapted to be received within a slot or channel (not shown) of the support member 130,132. Thus, according to example forms, the coupling components 122 preferably couple the tube 114 to the support members 130, 132. Optionally, the coupling component 122 can further include a fastener such as a spring biased latch (e.g., Valco button connector) or other connecters for removably coupling the ends of the light bar 110 to the support members 130, 132. In a preferred embodiment, such a latch enables a user or caregiver to selectively detach the coupling components 122 from the support members 130, 132 for disassembly.

As depicted in FIGS. 1-4, the support members or feet 130, 132 are generally formed from a durable polymer or other suitably rigid material and are adapted to rest on a support surface and support the light bar 110 above. At least one of the support members 130, 132 comprises an electronic control module housed therein, for example, which is programmed to activate an entertainment feature, for example, play sounds and/or activate the light feature or a vibe unit, and/or modulate these features (see FIGS. 3-4). The support members or feet 130, 132 are optionally weighted and have a wide flat base surface for stability and support. In example embodiments, one or both of the support members or feet 130, 132 house batteries for powering the light and sound features, one or more acoustic speakers, sound generators, and/or associated electronic controls.

In example forms, the light bar 110 is generally electrically connected with the electronic control module such that the plurality of color-changing RGB LED lights of the LED component 112, which are coupled in sequence along a length of the wire 116, are capable of illuminating to provide one or more colors of light along the length of the toy bar. According to example embodiments, one or more of the coupling components 122 is adapted to engage with the electronic module within the support member 130, for example, wherein an exposed electrical contact such as pin couplings (not shown) provided on the coupling component 122 (further connected to the LED component 112) interfaces with an electrical contact in the channel of the support member 130, thereby electrically connecting the electronic control module to the LED component 112. Optionally, one or more of the contacts may be spring-biased to ensure physical proximity to the other contact. In the example embodiment, at least one of the foot components 130, 132 further includes at least one control button 134, switch, or other actuator for a user to optionally select a module function.

Figure 4:
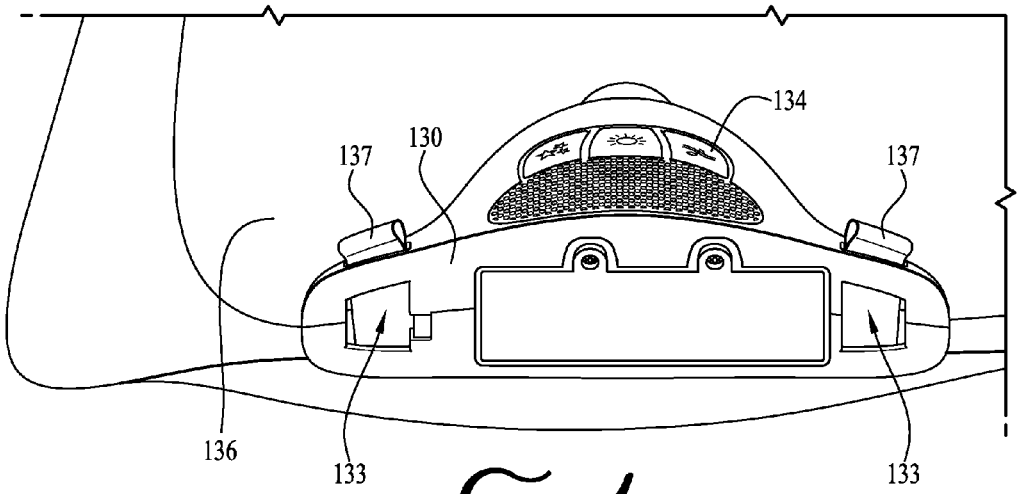
FIG. 4 is a bottom perspective view of a support member of the toy bar removably coupled to the mat of FIG. 1.

As depicted in FIGS. 1 and 4, the support members 130, 132 can be attached to a padded mat 136 that is adapted for a child to rest upon, the mat being configured to rest on a support surface. According to one example form, the mat comprises one or more straps 137 extending therefrom for removably coupling to channels 133 formed within the support members 130, 132. Generally, with the support members 130, 132 removably coupled to the straps 137, the toy bar 100 is stable and resists tipping over. According to example forms, the straps 137 are generally spaced a distance away from each other (for example, between about 75-400 millimeters) on each side of the mat 136 such that movement of the toy bar 100 or the support members 130, 132 generally further causes the mat 136 to be lifted, for example, since the straps extending from each side of the mat are generally spaced a distance away from each other. Thus, with the straps 137 being generally spaced a distance away from each other, the mat 136 (and the weight thereof) acts to help keep the toy bar 100 and support members 130, 132 stabilized. For example, if the toy bar 100 was to begin tipping over, the mat 136 will begin to be lifted, however, with the added weight of the mat 136, the toy bar 100 and support members 130, 132 will be brought back to an upright orientation. Furthermore, the base of the support members 130, 132, which are in contact with the support surface, preferably provide adequate stability, for example, which keeps the toy bar in the upright position. Optionally, other couplings, straps, fasteners, etc. may be provided for removably coupling the support members 130, 132 to the mat 136. In other example embodiments, the support members 130, 132 can be in the form of a clamp, clip, or other mechanism for coupling the toy bar 100 to a children's support device. Alternatively, the toy bar can be configured for resting on a support surface independently of coupling with the straps 137 of the mat 136. According to one form, the support members 130, 132 comprise a width $W_2$ of between about 150-350 millimeters, more preferably about 228 millimeters, and the height H of the toy bar 100 is generally between about 350-650 millimeters, more preferably about 520 millimeters. Preferably, with the height H of the toy bar 100 being between about 350-650 millimeters, the width $W_2$ of the support members 130, 132 is generally configured to provide a sufficient amount of stability to the toy bar 100 whereby forces acting against the tube component 114 do not cause the toy bar 100 to tip over. However, additional stability can be provided by coupling the support members 130, 132 to the mat 136. Furthermore, one or more coupling members or straps can be provided for coupling the support members together to maintain a spaced-apart footprint, for example, when the toy bar 100 is used without the mat, or wherein a mat is provided without coupling members for attachment to the mat.

As illustrated in FIG. 1, the toy bar 100 can include one or more toys 138 coupled thereto, and/or loops or fasteners for coupling toys. Optionally, the toy bar 100 can include a canopy 140. The canopy 140 can provide an interesting visual backdrop for the light bar 110 and/or provide shade.

Figure 5:
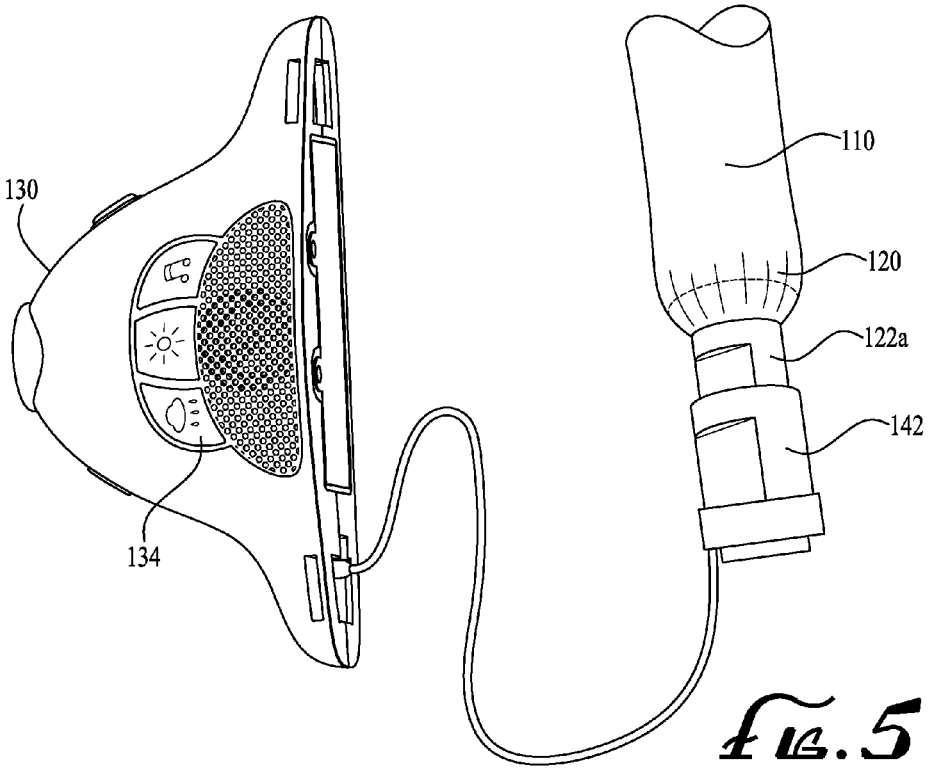
FIG. 5 is a side view of a support member of FIG. 1, and showing an adaptor for removably coupling to an end of the toy bar according to another example embodiment of the present invention.

Optionally, as depicted in FIG. 5, a sales display and demonstration adapter 142 can optionally be temporarily integrated with the present invention, for example, which provides an intermediary between the light bar 110 and the electronic module. The adapter 142 can be connected with the electronic module and allow a user to activate the module while the toy bar 100 is unassembled and in retail packaging. Thus, the light bar 110 can be electrically connected to the electronic module without the coupling component 122 being inserted within the support member 130. In one form, the support member 130 comprises a female jack (connected to the electronic module) that accepts a male connector extending from the adapter 142, and wherein the adapter is electrically connected to the coupling component 122. According to example forms, the jack is wired such that the circuit detects the presence of the connector and switches the play mode from a normal play mode (featuring long play melodies and light illumination) to a demonstration mode that features a significantly shorter run time. Thus, the adapter preferably limits the duration of the module's activity when activated, thereby preserving battery life and allowing a potential purchaser to experience the toy's function in a short period of time. Various changes and modifications to such a toy bar, beyond those explicitly mentioned herein, are contemplated as being within the scope of the present invention.

While the invention has been described with reference to preferred and example embodiments, it will be understood by those skilled in the art that a variety of modifications, additions and deletions are within the scope of the invention, as defined by the following claims.

What is claimed is:

1. A toy bar comprising:

a light transmissive tube component comprising a first end, a second end, and a channel extending through the tube component from the first end to the second end, the tube component having at least one light source positioned within the channel and configured for emitting light through the light transmissive tube component;

first and second foot members removably attached to the tube component, the first foot member removably attached to the first end and the second foot member removably attached to the second end, the first foot member defining a first channel formed therein, and the second foot member defining a second channel formed therein; and a mat positioned beneath the light transmissive tube component and between the first and second foot members for laying a child thereon, wherein at least one strap extends from each side of the mat for removably attaching to a respective one of the first and second foot members through the first and second channels.

2. The toy bar of claim 1, wherein the light source comprises an LED light component fitted within the channel of the light transmissive tube component.

3. The toy bar of claim 1, wherein the first and second foot members are configured for resting upon a support surface.

4. The toy bar of claim 1, wherein at least one coupling removably couples the first and second foot members together.

5. The toy bar of claim 2, wherein at least one of the foot members comprises an electronic module, and wherein the electronic module can be programmed to activate one or more of a plurality of entertainment or soothing features including playing sounds, the LED light component, or a vibration unit.

6. The toy bar of claim 5, further comprising one or more batteries for powering the electronic module.

7. The toy bar of claim 6, further comprising an adaptor for providing an intermediary between the LED light component and the electronic module.

8. The toy bar of claim 1, further comprising a canopy coupled to the tube component.

9. The toy bar of claim 8, further comprising one or more toys, loops or fasteners coupled to the tube component.

10. A toy bar comprising:

a light bar comprising a first end and a second end, and a light source positioned within a conduit extending through the light bar between the first and second ends;

a first support member detachably coupled to the first end of the light bar and a second support member detachably coupled to the second end of the light bar, each of the first and second support members having a flat base surface;

a mat comprising at least one coupling member, the at least one coupling member removably coupling the mat to at least one of the support members; and an electronic module housed within at least one of the support members, and in electrical contact with the light source.

11. The toy bar of claim 10, wherein the light bar comprises a tube component, having a channel extending therethrough, and wherein the light source comprises an LED component positioned within the channel of the tube component.

12. The toy bar of claim 11, wherein the LED component comprises a plurality of color-changing RGB LEDs coupled in sequence along a length of a wire, and wherein a plurality of spacers are fitted within the tube component for positioning the LED component within the tube component.

13. The toy bar of claim 10, wherein the electronic module can be programmed to activate one or more of a plurality of entertainment or soothing features including playing sounds, the LED light component, or a vibration unit.

14. The toy bar of claim 13, further comprising one or more batteries for powering the electronic module.

15. The toy bar of claim 12, further comprising an adaptor for providing an intermediary between the LED light component and the electronic module.

16. The toy bar of claim 10, further comprising a canopy coupled to the tube component.

17. The toy bar of claim 16, further comprising one or more loops or fasteners coupled to the light bar for coupling toys thereto.

18. A toy bar comprising:

a light tube having first and second ends and a conduit extending therethrough, and at least one light source positioned within the conduit, the at least one light source comprising an LED light strip retained in position within the conduit by a plurality of positioning clips;

first and second feet, the first foot configured for detachable connection with the first end of the light tube, and the second foot configured for detachable connection with the second end of the light tube; and an electronic module housed within at least one of the first and second feet and in electrical contact with the light source.

19. The toy bar of claim 18, wherein each of the first and second feet comprise a lower support base and an upper coupling element.

20. The toy bar of claim 19, further comprising coupling connectors at the first and second ends of the light tube for engagement with the upper coupling elements of the first and second feet.

21. A toy bar comprising:

first and second foot members spaced a distance apart from one another and defining a width therebetween, each of the first and second foot members comprising a base surface and a coupling receiver above the base surface, at least one of the first and second foot members comprising an electronic power source;

a mat attached at least partially between the first and second foot members for laying a child thereon;

a light transmissive tube component having a first end comprising a first coupling component for engagement with the coupling receiver of the first foot member, a second end comprising a second coupling component for engagement with the coupling receiver of the second foot member, and a channel extending through the tube component from the first end to the second end, the light transmissive tube component defining a continuously curved arch between its first and second ends extending over the mat and across the width between the first and second foot members; and a plurality of light sources positioned within the channel through the light transmissive tube component and in electrical contact with the electronic power source, for emitting light through the light transmissive tube component.

* * * * *